US005297458A

United States Patent [19]

Smith et al.

[11] Patent Number: 5,297,458

[45] Date of Patent: Mar. 29, 1994

[54] TORQUE WRENCH

[76] Inventors: Barry A. Smith; Rex M. Ickes, both of 7460 S. Reed Ct., Littleton, Colo. 80123

[21] Appl. No.: 885,278

[22] Filed: May 18, 1992

[51] Int. Cl.[5] ..... B25B 23/00

[52] U.S. Cl. ..... 81/124.3; 81/124.2

[58] Field of Search ..... 81/124.3, 121.1, 122, 81/124.2, 177.1, 177.6; 439/578, 583, 301, 302, 310, 311, 372

[56] References Cited

U.S. PATENT DOCUMENTS 4,791,837 12/1988 Main ..... 81/63.1

FOREIGN PATENT DOCUMENTS 889387 9/1953 Fed. Rep. of Germany ..... 81/124.3

2554315 6/1976 Fed. Rep. of Germany ..... 81/121.1

*Primary Examiner*—D. S. Meislin

*Attorney, Agent, or Firm*—Lowell W. Gresham; Jordan M. Meschkow; Don J. Flickinger

[57] ABSTRACT

An inexpensive torque wrench is installed on a particular object, such as an electrical cable connector, so that the object may be fastened to a counterpart by applying a torque that is within a predetermined torque range. The wrench is preferably formed as a single molded plastic unit. The wrench includes a ring-shaped collar and at least two fins extending outwardly from the collar on opposing sides thereof. The interior of the wrench is hollow and surrounded by an interior wall of the collar. The interior wall is dimensioned to tightly mate with the particular object on which it is installed. The fins are dimensioned to support the predetermined torque range and angled so that a slightly greater counterclockwise torque than clockwise torque may be applied. When the wrench is installed on the object, it may be removed by breaking off the fins so that the collar may then be separated into two halves. The two halves may then be disengaged from the object, thereby allowing a conventional open-end wrench to be used on the object in lieu of the torque wrench.

9 Claims, 3 Drawing Sheets

FIG. 4
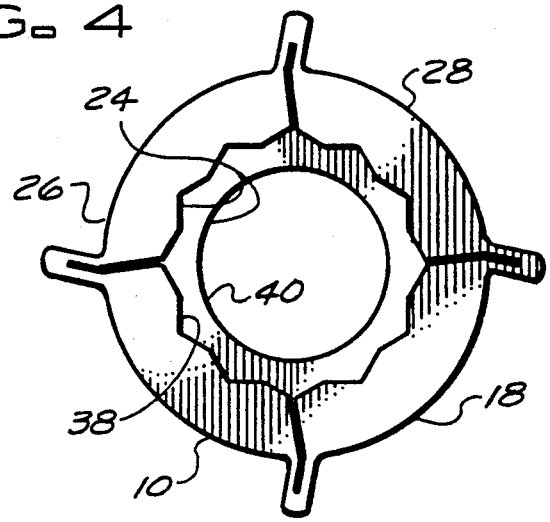
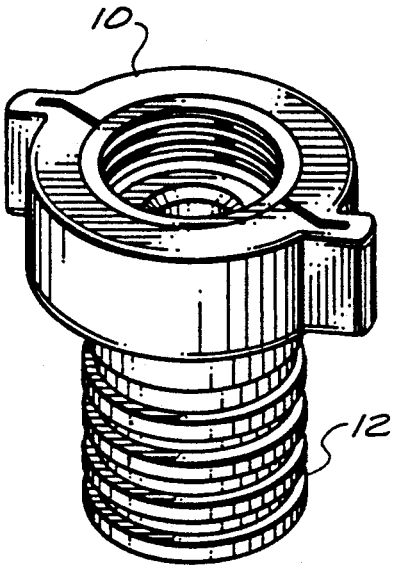
FIG. 5
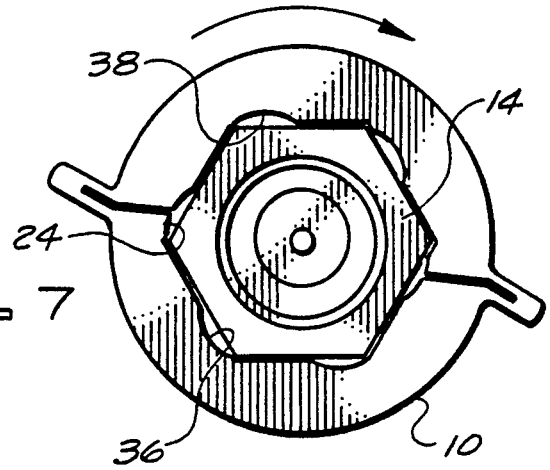
FIG. 7
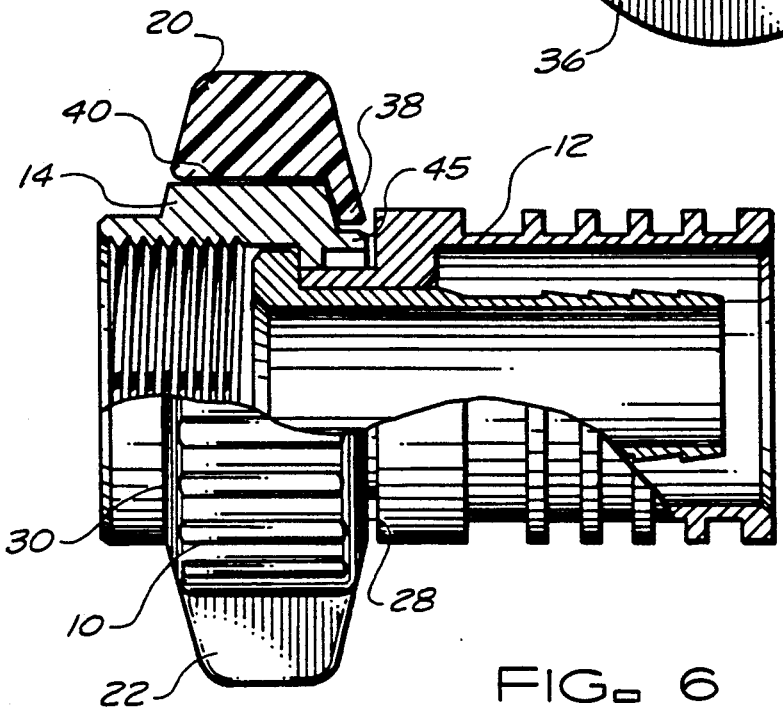
FIG. 6

TORQUE WRENCH

TECHNICAL FIELD OF THE INVENTION

The present invention relates generally to hand tools and similar devices which provide a mechanical advantage in manipulating objects. More specifically, the present invention relates to torque wrenches, which aid in the application of predetermined amounts of torque to objects.

BACKGROUND OF THE INVENTION

Many mechanical couplings require the application of predetermined amounts of torque to screw-type fastening devices. If insufficient torque is used to tighten screws, bolts, nuts, and the like, the resulting coupling may loosen over time and fail to serve its intended application. If too great of a torque is used in tightening fasteners, then damage is often experienced, either to the fastener itself or to components being fastened. Additionally, if too great a torque is applied, difficulty in unscrewing at a later time may be experienced. Accordingly, many fastening applications are reliably accomplished only by applying a torque from within a predetermined torque range to a fastening device.

Torque wrenches are well known tools which aid in the application of predetermined amounts of torque to objects. However, torque wrenches tend to be relatively expensive and complex tools. They are often overly precise. In other words, they allow a very precisely specified torque to be applied to an object when the fastening application may not require a great precision. Generally, torque wrenches are thought of as general purpose tools that may be adapted to numerous types of screws, bolts, nuts, and the like. Moreover, conventional torque wrenches are not generally available in the population and may be perceived as being complicated to use by the general population. As a general rule, manufacturers shy away from designing mass market products which require members of the general population to use torque wrenches before the products may be used in their intended applications.

One particularly troublesome fastening application relates to the mating of common connectors used in transmitting video and similar electrical signals. Such connectors include well known connectors referred to as "F" connectors by the industry. They include a threaded nut portion that is screwed onto a mating counterpart. If such connectors are not torqued sufficiently tight, then unwanted media ingress or egress often results. On the other hand, an over-tightened connection can cause damage to the connector and/or its mating counterpart, often breaking the mating counterpart off of equipment to which it is mounted.

While an acceptable range of torque for "F" connectors is relatively wide, the cable TV industry nevertheless experiences numerous problems related to improperly tightened connections. Customers become unsatisfied and vast resources are wasted in troubleshooting reported reception problems when connections become loose. Often, customers or poorly skilled workers damage customer equipment by using conventional wrenches to apply too great a torque to the connectors. Costly repairs result.

To complicate the attachment considerations, the same connectors which should not be tightened too much when mated with typical internal or inside-located equipment should receive a greater torque when mated to external or outside-located equipment for weather proofing. Marginally skilled workers often have difficulty is appreciating this distinction and often overtighten connectors attached to internal equipment or under-tighten connectors attached to external equipment.

Conventional "F" connectors often utilize a hexagonal nut which is adapted to receive a common open-end wrench. If the connector is hand-tightened, it is seldom torqued sufficiently tight for internal or external use. If the connector is tightened with an open-end wrench, it often receives too much torque, especially when the mating counterpart is internal equipment. A less common and more expensive conventional "F" connector utilizes a round knurled nut. The knurled nut allows the application of greater hand-tightened torque when compared to the hexagonal nut style of connector. However, it is not designed to mate with a wrench and can seldom be tightened to an acceptable level for external use. Moreover, when rusting, binding, or other removal problems arise, such connectors can be exceedingly difficult to remove.

SUMMARY OF THE INVENTION

Accordingly, it is an advantage of the present invention that an improved torque wrench is provided.

Another advantage of the present invention is that a torque wrench is provided which may be manufactured so inexpensively that it may be viewed as being disposable.

Yet another advantage is that the present invention provides a torque wrench which mates with conventional connectors.

Yet another advantage is that the present invention provides a torque wrench which may be permanently associated with a connector.

Yet another advantage is that the present invention provides a torque wrench which serves the dual roles of aiding in the application of proper torque to an object and distinguishing the object from other similar objects.

Still another advantage is that the present invention improves the reliability of applications which use conventional hexagonal nut connectors.

The above and other advantages of the present invention are carried out in one form by an improved wrench for aiding in the manual application of a torque to an object so that the torque is likely to be confined within a predetermined torque range. The wrench includes a ring-shaped collar having interior and exterior walls. The interior wall is configured to grasp an exterior surface of the object. The wrench also includes first and second rigid fins attached to said collar at said exterior wall thereof. The fins project outwardly from the collar.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. I shows a perspective view of a torque wrench configured in accordance with a first embodiment of the present invention;

FIG. 4 shows a back side view of a third embodiment of the torque wrench;

FIG. 5 shows a perspective view of the torque wrench installed on a connector;

FIG. 6 shows a partial cut-away side view of the second embodiment of the torque wrench installed on a connection;

FIG. 7 shows a back side view of the torque wrench after the application of excessive torque;

DETAILED DESCRIPTION OF THE PREFERRED EMBODIMENTS

Figure 1:
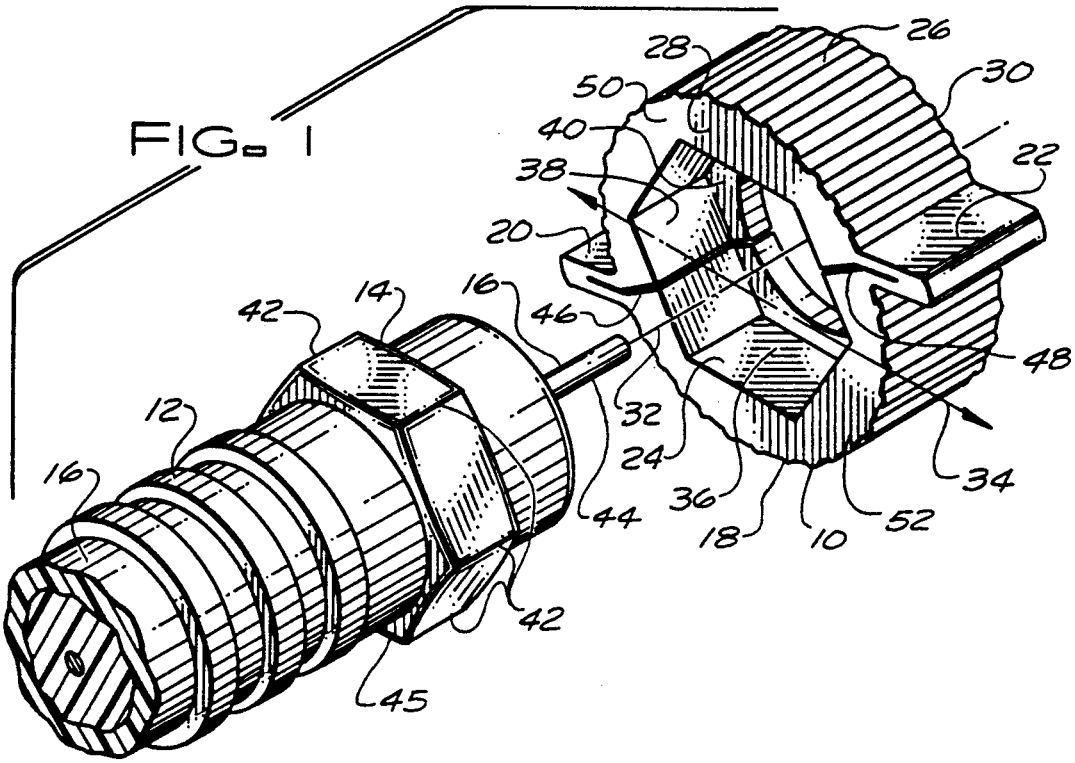

FIG. 1 shows a perspective view of a torque wrench 10 configured in accordance with a first embodiment of the present invention. Wrench 10 is configured to be adapted to a particular object, such as a connector 12. Although not entirely necessary, wrench 10 may be permanently associated with connector 12, but removable and disposable if not wanted. In accordance with presently preferred embodiments of the this invention, connector 12 is a conventional "F" connector having an external tightening surface, such as a hexagonal nut 14, which allows connector 12 to be tightened to a mating counterpart connector (not shown). FIG. 1 illustrates connector 12 as being installed on a cable 16. Cable 16 may, for example, transport video or other electrical signals, in a manner conventional in the cable TV, residential and business video, and related industries.

In accordance with one embodiment of the present invention, wrench 10 includes a ring-shaped collar 18 rigidly coupled to first and second fins 20 and 22, respectively. However, as illustrated in FIG. 4, wrench 10 is not limited to having only two fins and may be configured to include any number of fins. Preferably, collar 18 and fins 20–22 are integrally formed into a single unit. More preferably, the single unit which forms wrench 10 is made from a suitable plastic for achieving below-discussed features using a conventional injection or extrusion molding process.

Moreover, the preferred plastic material from which wrench 10 is made may be combined with dyes of various colors so that an assortment of wrenches 10 will exhibit a desired assortment of colors. The cable industry, for example, and others, may then dedicate wrenches 10 having one color to connectors 12 which serve one purpose, such as video in, and wrenches 10 having another color to connectors 12 which serve other purposes, such as video out. In this way, customer service personnel may identify particular connections to their customers by informing the customers of the colors associated with the particular connections. A savings in cable TV troubleshooting costs results because customers may participate in the troubleshooting process by following color-coded instructions given over the phone.

Figure 2:
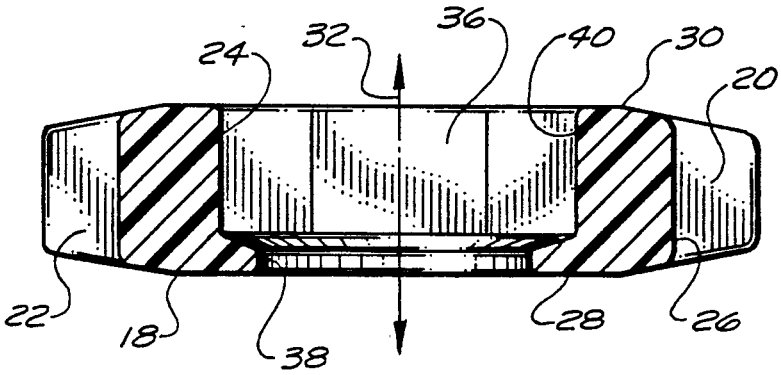
FIG. 2 shows a cross-sectional side view of a second embodiment of the torque wrench.
Figure 3:
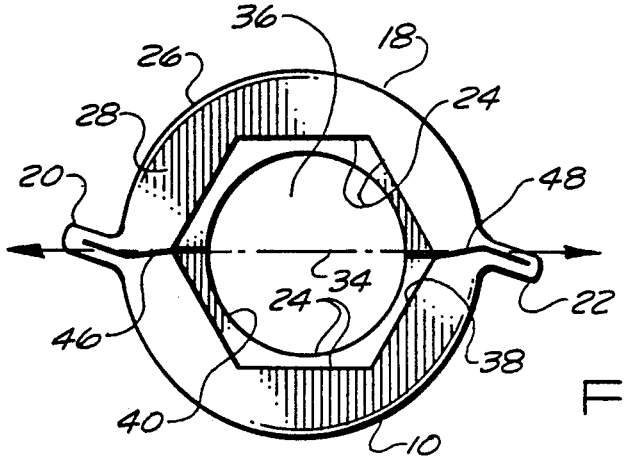
FIG. 3 shows a back side view of the first embodiment of the torque wrench.

FIG. 2 shows a cross-sectional side view of a second embodiment of the present invention. FIG. 3 shows a back side view of the first embodiment of torque wrench 10. With reference to FIGS. 1–3, collar 18 includes an internal wall 24 and an external wall 26. Fins 20–22 attach or otherwise meet collar 18 at external wall 26 on opposing sides of collar 18. Internal and external walls 24 and 26 each extend between a back side 28 of collar 18 to a front side 30 of collar 18. A back side 28 and a front side 30 reside substantially normal to an axial direction relative to collar 18, indicated by direction arrow 32 in FIGS. 1–2. Interior and exterior walls 24 and 26 surround axial direction 32 and extend predominantly in direction 32. A radial direction relative to collar 18, indicated by direction arrow 34 in FIGS. 1 and 3, extends normal to axial direction 32. In the presently preferred embodiments, exterior wall 26 has a generally cylindrical shape, and radial direction 34 extends generally perpendicular to all points of exterior wall 26.

Wrench 10 additionally includes a hollow interior 36. Hollow interior 36 is radially bounded by interior wall 24 and axially bounded by back and front sides 28 and 30, respectively. Interior 36 is not obstructed from the exterior of wrench 10 at back side 28. Thus, wrench 10 may mate with connector 12, and more particularly with hexagonal nut 14 thereof, by axial movement between connector 12 and wrench 10. This axial movement causes connector 12, or at least hexagonal nut 14, to enter hollow interior 36 of wrench 10 from back side 28, as shown in FIGS. 1 and 3. FIG. 5 illustrates a configuration that results from mating wrench 10 to connector 12.

Wrench 10 may alternatively mate with connector 12 by axial movement from front side 30 or may be mated with connector 12 during the manufacturing process for connector 12, as shown in connection with the second embodiment depicted in FIGS. 2 and 6.

With reference back to the first embodiment of the present invention depicted in FIGS. 1 and 3, interior wall 24 of wrench 10 includes an aft section 38, residing near back side 28, and a fore section 40, residing near front side 30 and distal to back side 28. Interior wall 24 in aft section 28 is configured into a six cornered shape, as shown in FIGS. 1 and 3, or a twelve cornered shape, as shown in FIG. 4. The corners of aft section 38 are dimensioned to snugly mate with corners 42 of nut 14 of connector 12. Hence, rotational motion and torque applied to wrench 10 will be transmitted to nut 14. On the other hand, interior wall 24 at fore section 40 is configured to block movement of connector 12 entirely through wrench 12 by restricting the size of the opening between hollow interior 36 and the exterior of wrench 10 at front side 30. The central portion of front side 30 remains open to permit the threads of connector 12 to mate with a counterpart connector (not shown) and a center conductor 44 (see FIG. 1) of cable 16 to extend therethrough.

With reference to the second embodiment of the present invention depicted in FIGS. 2 and 6, aft section 38 (rather than fore section 40) of interior wall 24 is configured to block movement of connector 12 entirely through wrench 12 by restricting the size of the opening between hollow interior 36 and the exterior of wrench 10 at back side 28. As best viewed in FIGS. 1 and 6, aft section 38 may be configured to mate with a sleeve 45 portion of connector 12 which resides behind nut 14. In this second embodiment, wrench 10 may be installed on connector 12 during the manufacturing of connector 12. In this second embodiment, interior wall 24 in fore section 30 is configured into a six or twelve cornered shape. The corners of fore section 40 are dimensioned to relatively loosely mate with corners 42 of nut 14 of connector 12.

Accordingly, in the preferred embodiments of the present invention, interior wall 24 is configured so that, once installed on connector 12, it grasps connector 12 and remains permanently attached thereto. In other words, wrench 10 is not intended to be removed from connector 12 without destroying wrench 10. This does not mean that wrench 10 cannot be removed from connector 12. Since wrench 10 is preferably molded from plastic, it is inexpensively made and may be removed and disposed of without concern. The permanent attachment of wrench 10 to connector 12 allows the assembled combination of wrench 10 and connector 12 to experience significant jostling and handling without wrench 10 becoming separated from connector 12. No special tools need to be located and manipulated when connector 12 is mated with a counterpart connector. In the first preferred embodiment for wrench 10 (see FIGS. 1 and 3–5), interior wall 24 is dimensioned to be securely installed on connector 12 by being press fit onto nut 14. In the second preferred embodiment for wrench 10 (see FIGS. 2 and 6) interior wall 24 is dimensioned to be securely installed on connector 12 by being blocked from axial movement by components of connector 12. However, in other embodiments, wrench 10 may be dimensioned for easy removal, and various alternative clamping features may be included in the design of wrench 10.

The design of fins 20 and 22 relates to the predetermined torque range that wrench 10 will provide to connector 12. The thickness and length of fins 22 are configured in cooperation with the hardness of the plastic material from which wrench 10 is formed so that fins 20 and 22 are relatively rigid. Thus, fins 20–22 do not significantly deform when a torque at the upper end of the torque range acceptable for connector 12 is applied thereto.

Moreover, the distance for which fins 20 and 22 project externally away from collar 18 is controlled so that the requisite torque range is likely to be applied by hand manipulation of wrench 10. Those skilled in the art will appreciate that a given amount of rotational effort manually applied at the ends of fins 20–22 will apply an amount of torque to nut 14 of connector 12 that is dependent on the length of fins 20–22. In the "F" connector application, fins 20–22 are preferably kept relatively short to prevent the application of excessive torque. In the preferred embodiment, fins 20–22 project outward from the radial center of collar 18 a distance of less than 0.5 inches and from external wall 26 a distance of less than 0.18 inches.

This length for fins 20–22 allows persons who hand-tighten connector 12 to its mating counterpart to apply significantly greater torque than may be applied by hand directly to hexagonal nut 14. However, the relative short length of fins 20–22 prevents persons who hand-tighten connector 12 from providing the kinds of torque likely to cause damage to typical internal equipment mating counterpart connectors. Those skilled in the art will appreciate that through the use of wrench 10, connector 12 will receive a tightening torque considerably less than the amounts of torque easily applicable by a conventional open-end wrench.

As best illustrated in FIG. 3, fins 20 and 22 form an acute angle with external wall 26, in a clockwise direction when viewed from back side 28. When wrench 10 is applied to an object, such as connector 12, having normal positive threads, clockwise rotation tightens the object. These tightening forces are applied to surfaces of fins 20–22 that slope away from the direction of the applied force. Consequently, as greater forces are applied, the user's fingers have a tendency to slip off, and the user naturally pinches or directs the forces closer to the center of wrench 10. On the other hand, when a counterclockwise, loosening force is applied, the force is directed to surfaces of fins 20–22 which slope toward the direction of the applied force. The fingers do not experience the same tendency to slip off, and the user naturally directs the forces to the outer most sections of fins 20–22. As a result, the angling of fins 20–22 allows a given amount of loosening effort to apply a greater loosening torque when compared to the tightening torque resulting from the same amount of effort. The application of a greater loosening torque is desirable because connectors occasionally bind, rust, or freeze on their mating counterparts and cannot be removed without applying an amount of torque that would be considered excessive for tightening.

FIG. 7 illustrates an optional feature of the present invention that further limits the maximum torque applicable through wrench 10 to nut 14. Nut 14 is typically constructed from a hard material, such as brass, aluminum, copper, steel, and occasionally a hard plastic. Wrench 10 is preferably constructed from a material which is softer than nut 14. Thus, when wrench 10 applies an amount of torque which is around, and preferably slightly greater than, the maximum torque suitable for nut 14, collar 18 in the vicinity of internal wall 24 deforms to allow slippage of collar 18 relative to nut 14, as shown in FIG. 7. Those skilled in the art will appreciate that the softness of the material from which wrench 10 is constructed may be designed in cooperation with the precise shape and dimensions of interior wall 24 to allow such slippage to occur at around any specified torque. Moreover, the precise shape of interior wall 24 may be biased so that such deformation occurs more readily in response to clockwise torque than to counterclockwise torque.

Referring back to FIG. 1, wrench 10 additionally includes slits 46 and 48 in association with fins 20 and 22, respectively. Slits 46–48 extend the width of collar 18 between back side 28 and front side 30 and between interior wall 24 and exterior wall 26 in the vicinity of fins 20 and 22. Moreover, slits 46–48 continue beyond external wall 26 of collar 18 into the central interior regions of fins 20–22, respectively. However, slits 46–68 do not extend to the outermost ends of fins 20–22 but terminate approximately half-way out fins 20–22. While slits 46–48 cooperate to separate collar 18 into two discrete separate halves 50 and 52, relatively small passages of material may continue through slits 46–48 as required during the molding of wrench 10. Moreover, halves 50 and 52 are held together by fins 20–22. Hence, wrench 10 functions as a single unit in spite of slits 46–48.

Figure 8:
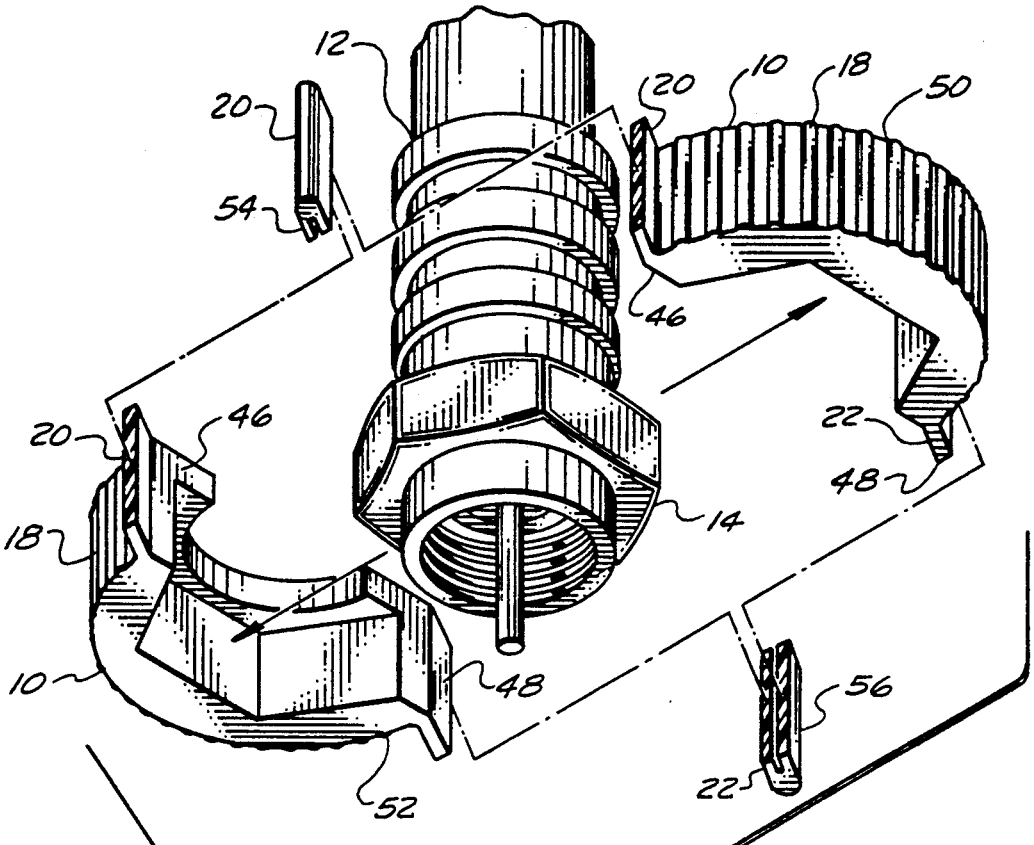
FIG. 8 presents a perspective view that illustrates the removal of the torque wrench from a connector.
Figure 9:
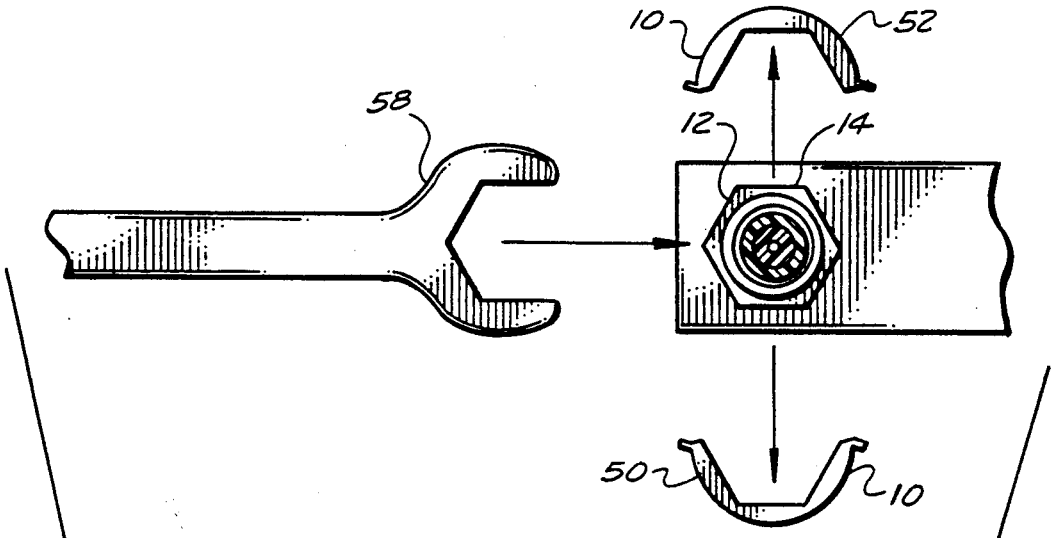
FIG. 9 shows a schematic view of the torque wrench in relation to mating equipment.

Slits 46–48 provide a convenient way to remove wrench 10 from an object, such as connector 12, to which it may be attached. As shown in FIGS. 8 and 9, ends 54 and 56 of fins 20 and 22, respectively, may be removed from wrench 10, by breaking, clipping, or in any other convenient manner. Once ends 54–56 of fins 20–22 have been clipped, little or no material holds halves 50 and 52 of collar 18 together. Consequently, wrench 10 may then be easily pulled apart and disengaged or pulled from connector 12. This action effectively destroys wrench 10, and wrench 10 may simply be disposed of thereafter. By removing wrench 10, a conventional open-end wrench, such as wrench 58 shown in FIG. 9, may be used with hexagonal nut 14 to apply greater torques than would otherwise be possible through wrench 10. Such additional torque may be desirable when a connector 12 is stuck to its counterpart connector and cannot otherwise be removed. Moreover, such additional torque may be desirable when connector 12 is being attached to certain external equipment.

In summary, the present invention provides an improved torque wrench. Improvements come from a simple construction which allows the wrench to be manufactured so inexpensively that it may be permanently attached to an object with which it is intended to be used, and it may be disposed of if not needed. The torque wrench of the present invention may be particularly advantageous when used with conventional connectors. Not only does the present invention serve the role of a torque wrench, but the present invention may be formed from a plastic material which can exhibit any desired color. Thus, the present invention may simultaneously serve the dual roles of color-coding for particular connectors and of a wrench. A preferred embodiment of the present invention is adapted for use in connection with a conventional hexagonal nut. Consequently, the advantages of improved reliability from hand-installation are achieved without diminishing the usefulness of the hexagonal nut which may mate with conventional wrenches. The low cost of the torque wrench of the present invention extends the usefulness of hexagonal nut connectors at an insignificant cost.

The present invention has been described above with reference to preferred embodiments. However, those skilled in the art will recognize that changes and modifications may be made in these preferred embodiments without departing from the scope of the present invention. For example, the torque wrench of the present invention need not be used only in connection with connectors but may be adapted for use in connection with a wide range of screw-type fastenings. In addition, the torque wrench of the present invention may operate satisfactorily with only one slit rather than the two discussed herein. Moreover, those skilled in the art will appreciate that the present invention supports a wide range in materials selection, dimensions, shapes, and the like. These and other changes and modifications which are obvious to those skilled in the art are intended to be included within the scope of the present invention.

What is claimed is:

1. A wrench for aiding in the manual application of a torque to an object so that said torque is likely to be confined within a predetermined torque range, said wrench comprising:

a ring-shaped collar having interior and exterior walls, said interior wall being configured to grasp an exterior surface of said object, and said collar and said interior wall thereof being configured with respect to said object to prevent removal of said wrench from said object without destroying said wrench; and first and second rigid fins attached to said collar at said exterior wall thereof, said fins projecting outward from said collar, wherein said collar includes at least one slit extending between said interior wall and said exterior wall in the vicinity of one of said fins so that said collar is held together at said slit through said one fin and so that said collar may be removed from said object by removing at least a portion of said one fin to allow said collar to expand at said slit.

2. A wrench for aiding in the manual application of a torque to an object so that said torque is likely to be confined within a predetermined torque range, said wrench comprising:

a ring-shaped collar having interior and exterior walls, said interior wall being configured to grasp an exterior surface of said object; and first and second rigid fins attached to said collar at said exterior wall thereof, said fins projecting outward from said collar, wherein said collar and fins are configured so that said fins project outward from a radial center of said collar a distance of less than 0.5 inches and from said external wall of said collar a distance of less than 0.18 inches.

3. A wrench for aiding in the manual application of a torque to a connector having an exterior tightening surface so that said torque is likely to be confined within a predetermined torque range, said wrench comprising:

a ring-shaped collar having interior and exterior walls, said interior wall being dimensioned with respect to said connector for secure attachment thereon at said exterior tightening surface, and said collar having at least one slit extending between said interior wall and said exterior wall;

a first rigid fin attached to said collar at said exterior wall thereof, said first fin projecting outward from said collar, and said first fin being positioned on said exterior wall at said slit so that said first fin holds said collar together and so that said collar may be removed from said connector by removing at least a portion of said first fin to allow said collar to expand at said slit; and a second rigid fin attached to said collar at said exterior wall thereof, said second fin projecting outward from said collar.

4. A wrench as claimed in claim 3 wherein said first and second fins project away from said collar at an angle with respect to a radial direction of said collar.

5. A wrench as claimed in claim 4 wherein each of said first and second fins forms an acute angle with said exterior wall of said collar, said acute angle extending in a clockwise direction when viewed from a back side of said collar, and said acute angle allowing the application of increased counterclockwise torque to said connector relative to clockwise torque applicable to said connector.

6. A wrench as claimed in claim 3 wherein said collar and said fins are integrally formed into a single plastic unit.

7. A wrench as claimed in claim 3 wherein said interior wall is configured to prevent substantial axial movement of said object relative to said collar.

8. A wrench as claimed in claim 3 wherein said collar is made from a material which is softer than a material from which said tightening surface of said connector is made so that said collar deforms in the vicinity of said interior wall to permit slippage of said connector tightening surface when a torque approximately at an upper limit of said torque range is applied thereto.

9. A connector having a built-in, removable wrench to accommodate a variety of tightening and loosening options, said connector comprising:

a hexagonal shaped tightening surface;

a ring-shaped collar having interior and exterior walls, said interior wall being dimensioned for secure attachment at said tightening surface, and said collar having a slit extending between said interior wall and said exterior wall; and a rigid fin attached to said collar at said exterior wall thereof, said fin projecting outward from said collar, and said fin being positioned on said exterior wall at said slit so that said fin holds said collar together and so that said collar may be removed from said tightening surface by removing at least a portion of said fin to allow said collar to expand at said slit.

* * * * *